US007301504B2

(12) United States Patent
Howell

(10) Patent No.: US 7,301,504 B2
(45) Date of Patent: Nov. 27, 2007

(54) MECHANICAL SCANNING FEED ASSEMBLY FOR A SPHERICAL LENS ANTENNA

(75) Inventor: James M. Howell, deceased, late of Woodstock, GA (US); by Anna N. Howell, legal representative, Woodstock, GA (US)

(73) Assignee: EMS Technologies, Inc., Norcross, GA (US)

( * ) Notice: Subject to any disclaimer, the term of this patent is extended or adjusted under 35 U.S.C. 154(b) by 301 days.

(21) Appl. No.: 11/181,377

(22) Filed: Jul. 14, 2005

(65) Prior Publication Data

US 2006/0017637 A1 Jan. 26, 2006

Related U.S. Application Data

(60) Provisional application No. 60/587,889, filed on Jul. 14, 2004.

(51) Int. Cl.
*H01Q 19/06* (2006.01)

(52) U.S. Cl. ..... 343/754; 343/753; 343/757; 343/909; 343/911 L

(58) Field of Classification Search ..... 343/753, 343/754, 757, 761, 765, 766, 909, 911 L, 343/911 R
See application file for complete search history.

(56) References Cited

U.S. PATENT DOCUMENTS 2,585,855 A * 2/1952 Sherwin et al. ..... 342/34
2,694,147 A * 11/1954 Feldman ..... 343/761
2,720,589 A * 10/1955 Proctor ..... 343/754
3,242,496 A * 3/1966 Moreno et al. ..... 343/754
4,804,970 A 2/1989 Todd
5,264,859 A * 11/1993 Lee et al. ..... 343/754
6,169,525 B1 1/2001 Dziadek et al.

(Continued)

FOREIGN PATENT DOCUMENTS

EP 0464647 A2 1/1992

(Continued)

OTHER PUBLICATIONS

Rondineau, Sébastien et al., A Sliced Spherical Lüneburg Lens, IEEE Antennas and Wireless Propagation Letters, 2003, pp. 163-166, vol. 2.

*Primary Examiner*—Tho Phan
(74) *Attorney, Agent, or Firm*—Troutman Sanders LLP; Filip A. Kowalewski; James Hunt Yancey, Jr.

(57) ABSTRACT

The invention includes a mechanical scanning feed and a spherical lens antenna system. The mechanical feed includes a waveguide, which has a movable wall assembly that contains a guide slot. The moveable wall portion also includes an end wall that is located proximate to the guide slot to prevent leakage of the propagating energy out of the waveguide. The mechanical feed also includes a drive mechanism, which moves the moveable wall assembly along the waveguide in a direction that is parallel to the direction of propagation of the energy. This allows the guide slot to be positioned at any elevation angle to allow a portion of the propagating energy to exit through the guide slot. This in combination with the waveguide being able to be rotated 360 degrees about the spherical lens provides the antenna system with nearly spherical coverage.

24 Claims, 5 Drawing Sheets

U.S. PATENT DOCUMENTS

| | | | |
|---|---|---|---|
| 6,304,225 | B1 | 10/2001 | Hemmi |
| 6,356,247 | B1 | 3/2002 | Hirtzlin et al. |
| 6,433,936 | B1 | 8/2002 | Carpenter et al. |
| 6,549,173 | B1 | 4/2003 | King et al. |
| 6,674,392 | B1 | 1/2004 | Schmidt et al. |
| 2002/0028677 | A1 | 3/2002 | Johnson et al. |
| 2004/0061948 | A1 | 4/2004 | Strickland |

FOREIGN PATENT DOCUMENTS

| | | | |
|---|---|---|---|
| EP | 0582793 | B1 | 2/1994 |
| EP | 0587810 | B1 | 3/1994 |
| EP | 0632522 | B1 | 4/1995 |
| EP | 0632524 | B1 | 4/1995 |
| EP | 0706233 | A1 | 4/1996 |
| EP | 0786825 | B1 | 7/1997 |
| EP | 0810686 | A2 | 12/1997 |
| EP | 0849825 | A2 | 6/1998 |
| EP | 0903807 | A2 | 3/1999 |
| EP | 0937314 | B1 | 8/1999 |
| EP | 0969549 | A1 | 1/2000 |
| EP | 0969550 | A1 | 1/2000 |
| EP | 0985248 | B1 | 3/2000 |
| EP | 1006611 | A2 | 6/2000 |
| EP | 1091915 | A1 | 4/2001 |
| EP | 1126545 | A1 | 8/2001 |
| EP | 1253668 | A1 | 10/2002 |
| EP | 1286418 | A1 | 2/2003 |
| EP | 1291966 | A1 | 3/2003 |
| EP | 1296411 | A2 | 3/2003 |
| EP | 1147572 | B1 | 5/2003 |
| EP | 1437796 | A1 | 7/2004 |
| JP | 56025806 | A | 3/1981 |
| JP | 58042303 | A | 3/1983 |
| JP | 60074802 | A | 4/1985 |
| JP | 60253305 | A | 12/1985 |
| JP | 61066402 | A | 4/1986 |
| JP | 62204605 | A | 9/1987 |
| JP | 62258505 | A | 11/1987 |
| JP | 01282904 | A | 11/1989 |
| JP | 01282905 | A | 11/1989 |
| JP | 03080604 | A | 4/1991 |
| JP | 03080704 | A | 4/1991 |
| JP | 03096104 | A | 4/1991 |
| JP | 03104402 | A | 5/1991 |
| JP | 03119807 | A | 5/1991 |
| JP | 03147407 | A | 6/1991 |
| JP | 03178204 | A | 8/1991 |
| JP | 03179805 | A | 8/1991 |
| JP | 04061403 | A | 2/1992 |
| JP | 04079403 | A | 3/1992 |
| JP | 04134908 | A | 5/1992 |
| JP | 04167803 | A | 6/1992 |
| JP | 04185105 | A | 7/1992 |
| JP | 04192802 | A | 7/1992 |
| JP | 04207606 | A | 7/1992 |
| JP | 04326604 | A | 11/1992 |
| JP | 04326605 | A | 11/1992 |
| JP | 05048318 | A | 2/1993 |
| JP | 05048319 | A | 2/1993 |
| JP | 05083018 | A | 4/1993 |
| JP | 05191133 | A | 7/1993 |
| JP | 05291819 | A | 11/1993 |
| JP | 05291820 | A | 11/1993 |
| JP | 05315830 | A | 11/1993 |
| JP | 06006126 | A | 1/1994 |
| JP | 06006128 | A | 1/1994 |
| JP | 06085773 | A | 3/1994 |
| JP | 06196915 | A | 7/1994 |
| JP | 06252634 | A | 9/1994 |
| JP | 06291538 | A | 10/1994 |
| JP | 07016861 | A | 1/1995 |
| JP | 07016862 | A | 1/1995 |
| JP | 07016941 | A | 1/1995 |
| JP | 07022834 | A | 1/1995 |
| JP | 07030324 | A | 1/1995 |
| JP | 07079114 | A | 3/1995 |
| JP | 07086827 | A | 3/1995 |
| JP | 07099407 | A | 4/1995 |
| JP | 08139514 | A | 5/1996 |
| JP | 08167811 | A | 6/1996 |
| JP | 08186434 | A | 7/1996 |
| JP | 09130137 | A | 5/1997 |
| JP | 09174596 | A | 7/1997 |
| JP | 09181523 | A | 7/1997 |
| JP | 09191212 | A | 7/1997 |
| JP | 09199936 | A | 7/1997 |
| JP | 09223924 | A | 8/1997 |
| JP | 09307342 | A | 11/1997 |
| JP | 09331207 | A | 12/1997 |
| JP | 10013146 | A | 1/1998 |
| JP | 10022726 | A | 1/1998 |
| JP | 10256814 | A | 9/1998 |
| JP | 11122022 | A | 4/1999 |
| JP | 11243317 | A | 9/1999 |
| JP | 11298237 | A | 10/1999 |
| JP | 11340730 | A | 12/1999 |
| JP | 2000022436 | A | 1/2000 |
| JP | 2000022437 | A | 1/2000 |
| JP | 2000082916 | A | 3/2000 |
| JP | 2000101302 | A | 4/2000 |
| JP | 2000101336 | A | 4/2000 |
| JP | 2000124727 | A | 4/2000 |
| JP | 2000134031 | A | 5/2000 |
| JP | 2000174543 | A | 6/2000 |
| JP | 2000183645 | A | 6/2000 |
| JP | 2000209022 | A | 7/2000 |
| JP | 2000278029 | A | 10/2000 |
| JP | 2000278030 | A | 10/2000 |
| JP | 2001085936 | A | 3/2001 |
| JP | 2001127537 | A | 5/2001 |
| JP | 2001184945 | A | 7/2001 |
| JP | 2001223521 | A | 8/2001 |
| JP | 2001237635 | A | 8/2001 |
| JP | 2001250423 | A | 9/2001 |
| JP | 2001284957 | A | 10/2001 |
| JP | 2001316514 | A | 11/2001 |
| JP | 2001320230 | A | 11/2001 |
| JP | 2002016424 | A | 1/2002 |
| JP | 2002016435 | A | 1/2002 |
| JP | 2002026553 | A | 1/2002 |
| JP | 2002121310 | A | 4/2002 |
| JP | 2002124822 | A | 4/2002 |
| JP | 2002171119 | A | 6/2002 |
| JP | 2002197923 | A | 7/2002 |
| JP | 2002223116 | A | 8/2002 |
| JP | 2002319818 | A | 10/2002 |
| JP | 2002374124 | A | 12/2002 |
| JP | 2003017932 | A | 1/2003 |
| WO | WO 8301711 | A1 | 5/1983 |
| WO | WO 8606881 | A1 | 11/1986 |
| WO | WO 9310572 | A1 | 5/1993 |
| WO | WO 9324307 | A1 | 12/1993 |
| WO | WO 9529517 | A1 | 11/1995 |
| WO | WO 9810305 | A1 | 3/1998 |
| WO | WO 9815033 | A1 | 4/1998 |
| WO | WO 9820579 | A1 | 5/1998 |
| WO | WO 9854788 | A1 | 12/1998 |
| WO | WO 9962137 | A1 | 12/1999 |
| WO | WO 9962841 | A1 | 12/1999 |
| WO | WO 9963624 | A1 | 12/1999 |
| WO | WO 0016441 | A1 | 3/2000 |
| WO | WO 0025387 | A1 | 5/2000 |
| WO | WO 0035050 | A1 | 6/2000 |

| | | | |
|---|---|---|---|
| WO | WO 0065691 | A1 | 11/2000 |
| WO | WO 0076027 | A1 | 12/2000 |
| WO | WO 0076028 | A1 | 12/2000 |
| WO | WO 0076030 | A1 | 12/2000 |
| WO | WO 0148511 | A1 | 7/2001 |
| WO | WO 0148549 | A1 | 7/2001 |
| WO | WO 0180357 | A1 | 10/2001 |
| WO | WO 0210802 | A1 | 2/2002 |
| WO | WO 02087018 | A1 | 10/2002 |
| WO | WO 03016962 | A1 | 2/2003 |
| WO | WO 03052870 | A1 | 6/2003 |
| WO | WO 2004086563 | A1 | 10/2004 |
| WO | WO 2004109856 | A1 | 12/2004 |
| WO | WO 2005002841 | A1 | 1/2005 |
| WO | WO 2005013420 | A1 | 2/2005 |
| WO | WO 2005062425 | A1 | 7/2005 |

* cited by examiner

MECHANICAL SCANNING FEED ASSEMBLY FOR A SPHERICAL LENS ANTENNA

CROSS-REFERENCE TO RELATED APPLICATIONS

This application claims priority to U.S. Provisional Patent Application Ser. No. 60/587,889 filed on Jul. 14, 2004, which is incorporated herein.

TECHNICAL DESCRIPTION OF THE INVENTION

The present invention is directed to a mechanical feed assembly for a radio frequency (RF) antenna, and more particularly to a mechanical scanning feed assembly for a dielectric spherical lens antenna.

BACKGROUND

Spherical dielectric lenses, also known as Luneberg lenses, have been widely used for antenna systems. A Luneberg lens is a spherical lens in which the dielectric constant varies as a function of the radius of the lens. The spherical lens shape has no intrinsic optical axis. Therefore, when a plane wave is incident on the Luneberg lens, the wave encounters an effective optical axis in the direction of the plane wave. The energy of the plane wave is then focused at a single focal point on the opposite side of the lens. This allows the lens to operate on multiple plane waves that are incident from different directions with little or no interference. Accordingly, the spherical lens is ideally suited for use in a multi-beam antenna system.

Conventional multi-beam antenna systems, which utilize a spherical lens, use a feed assembly that consists of a horn cluster and a switch tree made up of a number of switching circulators. Unfortunately, these conventional feed assemblies have several drawbacks. First, the conventional feed assemblies require a large number of active switching devices, which increases the complexity and the cost of the antenna system. Secondly, because the feed assemblies use horn clusters, the antennas can only provide hemispherical coverage due to blockage by the horn cluster. Finally, because the horn cluster fixes the beam pattern on a grid, these antennas experience losses due to scalloping.

Therefore, there is a continuing need for an inexpensive and low cost antenna feed for a beam scanning for a spherical dielectric lens antenna. In particular, there is a need for an inexpensive and low-loss antenna feed for a multi-beam RF spherical dielectric lens antenna that can provide spherical coverage.

SUMMARY OF THE INVENTION

The present invention meets the needs described above in a low-cost, low-loss mechanical feed that can be used to provide beam scanning for a spherical lens (Luneberg lens) antenna. Generally described, the invention includes a mechanical scanning feed for a spherical lens antenna. The mechanical feed includes a waveguide, which has a movable wall assembly that contains a guide slot. The moveable wall assembly also includes an end wall that is located proximate to the guide slot to prevent leakage of the energy propagating within the waveguide. The mechanical feed also includes a drive mechanism, which can move the moveable wall assembly along the waveguide so that the guide slot slides within the waveguide parallel to the direction of the propagating energy.

More particularly described, the moveable wall assembly may contain a single wall portion, which may contain a number of guide slots, which have a width dimension and a length dimension. The dimensions of each of the guide slots may be identical, or in some instances, the dimension of each guide slot, particularly the width dimension, may be different to provide beam forming capabilities.

Additionally, the moveable wall assembly may contain more than one moveable wall portion. In particular, the moveable wall assembly may contain a first moveable wall portion that has a single guide slot having a given width dimension and a second moveable wall portion located proximate to the first wall portion, which contains a number of additional guide slots. Each of the guide slots in the second moveable wall portion has a width dimension that is less than the width dimension of the guide slot in the first moveable wall portion. This allows the second movable wall portion and the first movable wall portion to be moved independently of one another so that at least one of the guide slots in the second moveable wall portion can be aligned with the guide slot of the first moveable wall portion, thereby altering the beam pattern of the antenna.

The invention may also be directed to an antenna system that includes a dielectric lens, a radio frequency source, and a feed assembly. The dielectric lens may be a spherical lens, also known as a Luneberg lens. The feed assembly contains a waveguide that includes a movable wall assembly with a guide slot, which allows a portion of the propagating energy to exit the waveguide. The feed assembly also includes a drive mechanism, which is capable of manipulating the movable wall assembly along the waveguide in a direction parallel to the propagation path of the energy within the waveguide. The motion of the moveable wall assembly by the drive mechanism changes an elevation angle of the guide slot. In addition, the waveguide may be curved, so that the curvature of the waveguide substantially approximates the curvature of the spherical dielectric lens.

The various aspects of the present invention may be more clearly understood and appreciated from a review of the following detailed description of the disclosed embodiments and by reference to the appended drawings and claims.

DETAILED DESCRIPTION OF THE EMBODIMENTS

Figure 1:
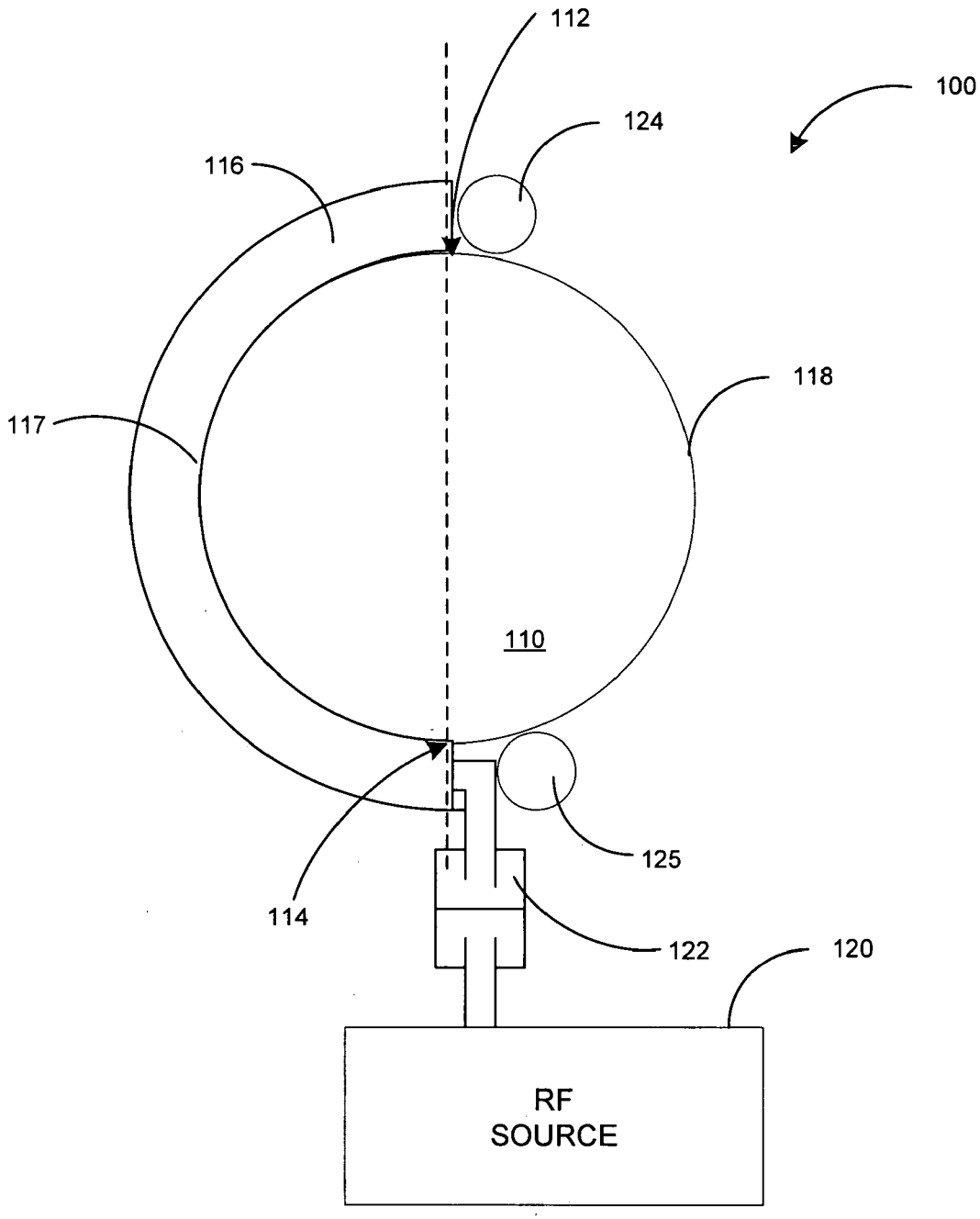
FIG. 1 is an illustration of an antenna system in accordance with some embodiments of the present invention.

Turning now to the figures, in which like numerals refer to like elements through the several figures, FIG. 1 is a radio frequency (RF) antenna system 100 in accordance with some embodiments of the present invention. Antenna system 100 includes a spherical dielectric lens 110 which contains a North Pole 112 (the top of the lens) and a South Pole 114 (the bottom of the lens). Antenna system 100 also includes a waveguide 116 that extends from the South Pole 114 to the North Pole 112. The waveguide 116 is curved to substantially match the curvature of the spherical lens 110 so that a bottom broadwell 117 of the waveguide 116 is proximate to or in contact with the outer surface 118 of the spherical lens 110. Typically, the waveguide 116 will have a rectangular cross section, although those skilled in the art will appreciate that the waveguide 116 may have cross sections of different shapes, such as circular or elliptical, without departing from the scope of the invention. The waveguide 116 may be rotated in azimuth about the spherical lens 110 to provide complete spherical coverage.

The antenna system 100 also contains a radio frequency (RF) power source 120, which may be located below the lens 110. The RF power source 120 feeds the waveguide 116 through a rotary joint 122, which is located just below the South Pole 114 of the spherical lens 110.

Figure 2A:
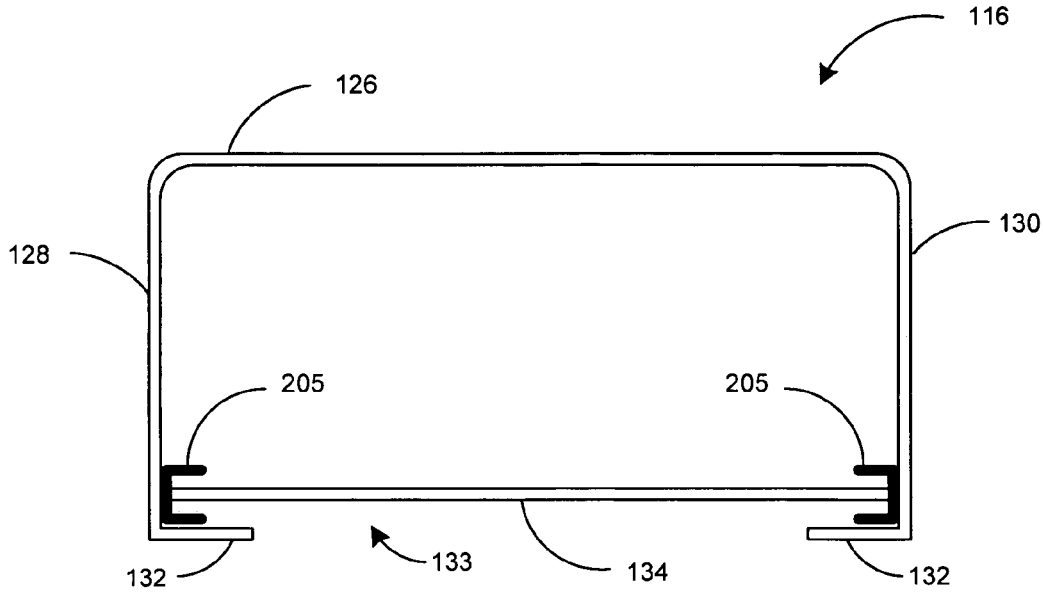
FIG. 2A is an illustration of a cross-sectional of a waveguide taken perpendicular to the energy propagation path in accordance with some embodiments of the present invention.

FIG. 2A illustrates a cross-section of the waveguide 116 taken perpendicular to the propagation path of the energy. The waveguide 116 contains a top wall 126 and two sidewalls 128, 130. Typically, the top wall 126 and the sidewalls 128, 130 may be manufactured from a single piece of material. For example, the top wall 126 and the sidewalls 128, 130 may be extruded from a continuous sheet of aluminum. Alternatively, the top wall 126 may be fastened to each sidewall 128, 130 by welding. Those skilled in the art will appreciate that other methods for manufacturing the top wall 126 and the sidewalls 128, 130 may be used without departing from the scope of the invention. The waveguide 116 may also contain a lip 132 at the distal end of each sidewall 128, 130 opposite the top wall 126, which curve inward and form a guide. The waveguide 116 also includes a moveable wall assembly 133, which rests on top of the lip 132 of each sidewall 128, 130 and is capable of sliding up and down within the curved rectangular waveguide 116. In one exemplary embodiment, the moveable wall assembly 133 contains a single moveable bottom wall 134 that rests on top of the lip 132 on each sidewall 128, 130.

Figure 2B:
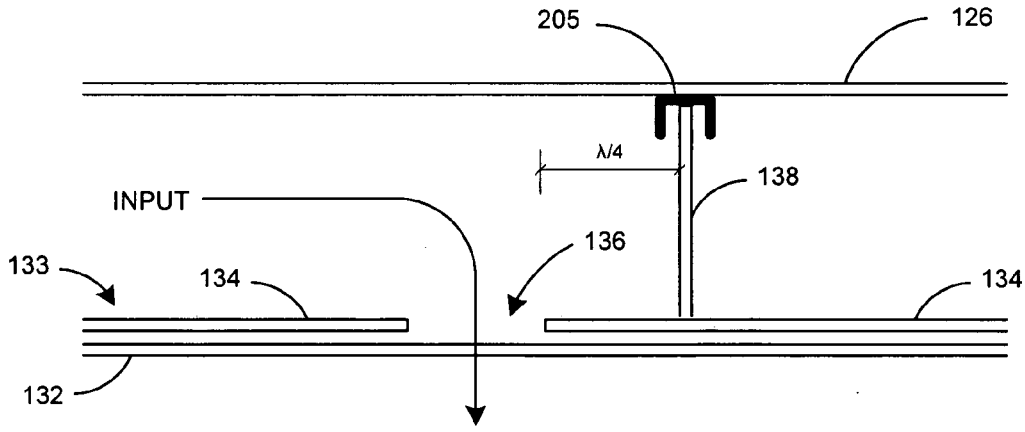
FIG. 2B is an illustration of a cross-sectional view of the waveguide taken parallel to the energy propagation path in accordance with an exemplary embodiment of the present invention.

FIG. 2B illustrates a cross-sectional view of the waveguide 116 taken parallel to the propagation path of the energy. The bottom wall 134 contains a guide slot 136, which is oriented perpendicular to the direction of travel of the bottom wall 134 and provides the feed for exciting the spherical lens 110. The bottom wall 134 also contains an electric end wall 138 that is located a quarter wave length ($\lambda/4$) beyond the guide slot 136 in order to prevent energy from radiating past the guide slot 136. In one embodiment, the bottom wall 134 may be made from a flat metallic tape. The flat metallic tape is typically held in a reserve roll at the South Pole 114 end of the waveguide 116. As the guide slot is moved upward toward the North Pole 112 end of the waveguide 116, the flat metallic tape is unrolled and extended along the length of the waveguide 116 forming a sealed cavity.

Figure 2C:
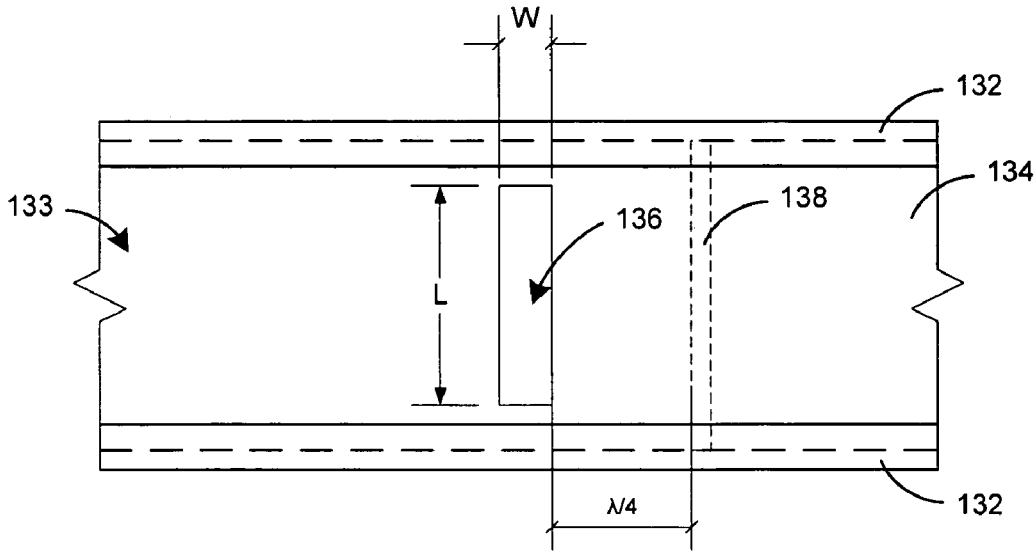
FIG. 2C is an illustration of a bottom view of the waveguide in accordance with an exemplary embodiment of the present invention.

FIG. 2C illustrates a bottom view of the curved rectangular waveguide 116. The guide slot 136 has a width, W, that is typically less than the distance between the two lips of the 132 of the sidewalls 128, 130. This helps prevent any energy from leaking out of the two sides where the bottom wall 134 comes in contact with the lip 132. The single guide slot 136 will project a single pencil beam perpendicular to the bottom wall 134.

To prevent leakage of the energy along the bottom lip of the sidewall 128, 130 where the bottom wall 134 slides along the lip 132, choke joints 205 may be used. (See FIG. 2A). A T-ridge choke joint 205 supported by the side wall 128, 130 may be used to keep the electromagnetic (EM) fields away from the bottom of the side wall 128, 130 to minimize leakage while providing strong field strength in the vicinity of the guide slot 136. The end wall 138, which must move relative to the top wall 126, must also have at least one choke joint 205 to prevent the energy from radiating past the end wall 138. The end wall 138 may be connected between the top wall 126 and the bottom wall 134 to provide good contact and a tight seal, however, the top wall 126 must also move with the bottom wall 134. Additionally, the entrance and exit slots for passing the bottom wall 134 into and out of the waveguide 116 must also contain choke joints 205 to prevent leakage of energy out of the waveguide 116.

The antenna system 100 also includes a drive mechanism for manipulating the position of the bottom wall 134 within the waveguide 116. The drive mechanism may include a pair of motors 124, 125. A first motor 124 is positioned at the North Pole 112 of the spherical lens 110, while the second motor 125 is positioned located at the South Pole 114 of the spherical lens 110. The first motor 124 can pull the bottom wall 134 up the waveguide 116 toward the North Pole 112, while the second motor 125 can pull the bottom wall 134 down the waveguide toward the South Pole 114 to position the guide slot 136 at any elevation angle between −90 degrees latitude (South Pole 114) and +90 degrees latitude (North Pole 112). Furthermore, by swinging the curved rectangular waveguide 116 around the spherical lens 110 from 0 degrees to 360 degrees in azimuth in combination with moving the bottom wall 134 vertically along the curved rectangular waveguide 116 so that the guide slot 136 may be positioned at any latitudinal position, a beam pattern may be formed at any elevation and azimuth position to provide approximately spherical coverage.

Figure 3:
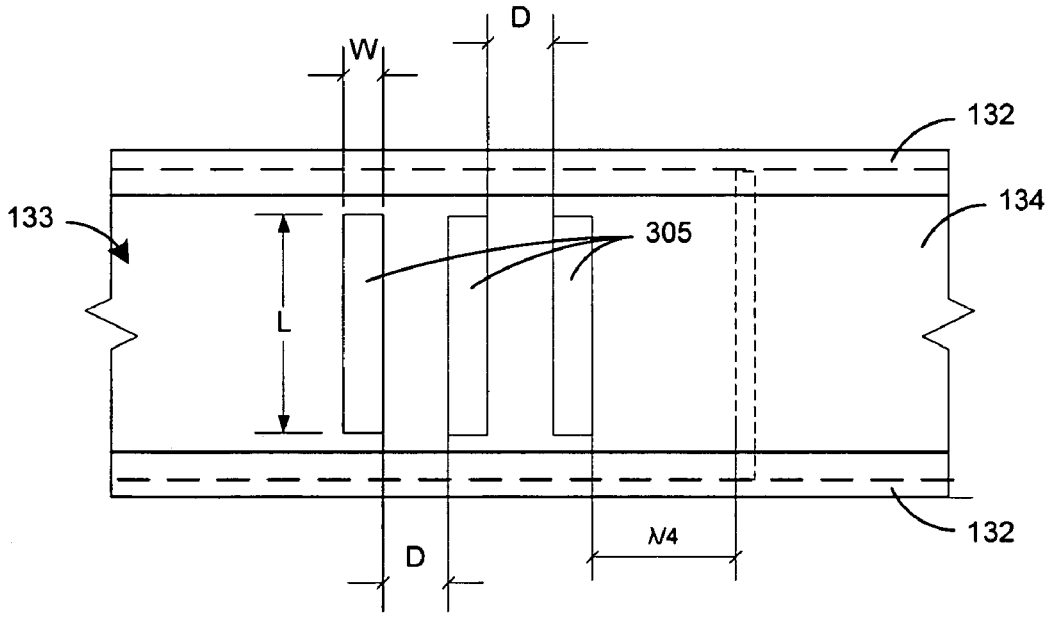
FIG. 3 is an illustration of a bottom view of the waveguide in accordance with another exemplary embodiment of the present invention.

FIG. 3 is an illustration of another exemplary embodiment of the bottom wall 134. The bottom wall 134 includes several guide slots 305. Each guide slot 305 has a length L and width W and is spaced apart from one another by a distance D. The distance D, between the guide slots 305 controls the phase of the beam, while the dimensions, W and L, of the guide slots 305 control the amplitude of the wave. Thus, by varying the spacing between adjacent guide slots 305 and the dimension of each guide slot 305, a shaped beam may be scanned in azimuth and elevation. In one embodiment, the spacing, D, between the guide slots 305 is constant. In another embodiment, the spacing, D, between adjacent guide slots 305 may vary. In yet another embodiment, the dimensions, W and/or L, of the guide slots 305 may also vary from one guide slot 305 to another guide slot 305.

Figure 4A:
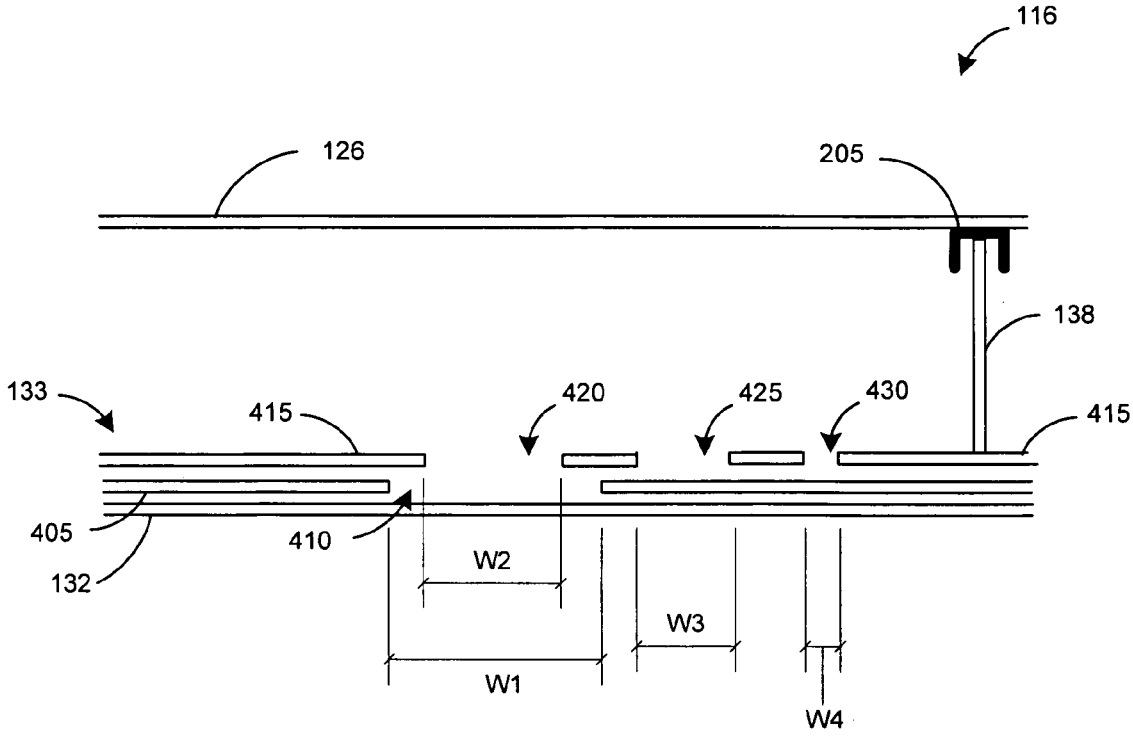
FIG. 4A is an illustration of a cross-section al view of the waveguide taken parallel to the propagation path in accordance with another exemplary embodiment of the present invention.
Figure 4B:
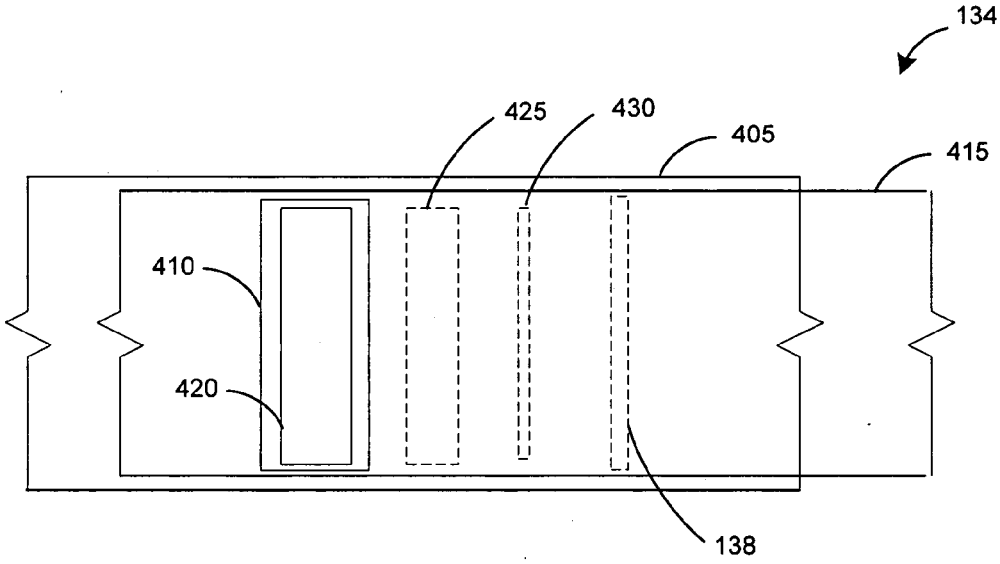
FIG. 4B is an illustration of a bottom view of the waveguide of FIG. 4B.

FIG. 4A is a cross-sectional view of another exemplary embodiment of the waveguide 116 utilizing the moveable wall assembly 133. The moveable wall assembly 133 contains at least two separate bottom walls, which each contain separate guide slots. In one embodiment, the moveable wall assembly 133 contains a first bottom wall 405 that has a first guide slot 410 that has a width W1 and a second bottom wall 415 that lies above or in close contact with the first bottom wall 405. The second bottom wall 415 contains several guide slots. For example, the second bottom wall 415 may have a first guide slot 420 that has a width W2, a second guide slot 425 that has a width W3, and a third guide slot 430 that has a width W4. Typically, the width W1 of the guide slot 410 of the first bottom wall 405 is greater than the width of any of the widths W2 of the first guide slot 420, width W3, of the second guide slot 425, and W4 of the third guide slot 430 of the second bottom wall 415. In this manner, by aligning the first guide slot 420, the second guide slot 425, or the third guide slot 430 of the second bottom wall 415 with the wider opening of the guide slot 410 of the first bottom wall 405, different beam shapes may be obtained. FIG. 4B illustrates a bottom view of the moveable wall assembly 133 in use with the waveguide 116. Although the second bottom wall 415 is described as having three guide slots 420, 425, and 430, those skilled in the art will appreciate that the second bottom wall 415 may contain any number of guide slots without departing from the scope of the invention.

Figure 5:
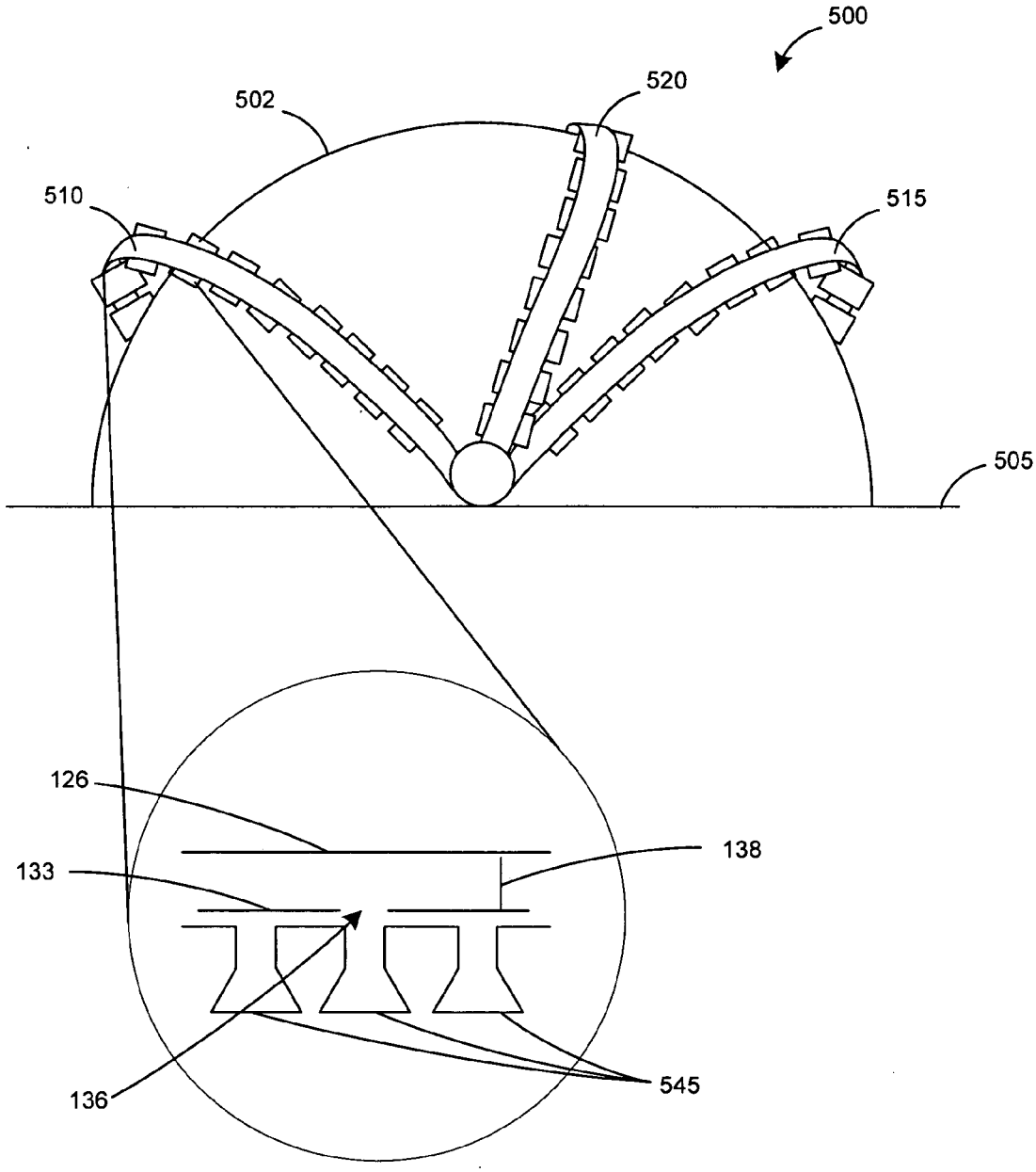
FIG. 5 is an illustration of a multi-beam antenna system in accordance with some embodiments of the present invention.

FIG. 5 illustrates a multi-beam antenna system 500 in accordance with some embodiments of the present invention. The antenna system 500 combines a hemispherical lens 502 with a reflective plate, or ground plane 505. The ground plane 505 allows the use of a hemispherical lens 502 rather than a spherical lens, which reduces the size of the antenna system 500. Rather than having a single waveguide, as described above, the multi-beam antenna system 500 may contain several waveguides operating at different frequencies.

As shown in FIG. 5, there is a first waveguide 510 that feed a series of horn radiators 545 operating at 30 gigahertz (GHz), a second waveguide 515 that feed a second series of horn radiators 545 operating at 30 GHz, and a third waveguide 520, which feeds a series of horn radiators 545 at 44 GHz. Each waveguide uses a series of horn radiators 545 rather than a single aperture. Each waveguide also contains a moveable wall assembly 133, as described above. The moveable wall assembly 133 may be moved within each waveguide to position the guide slot 136 over a particular horn radiator 545. By using multiple waveguides and a multiple channel rotary joint 530, several independent beams may be achieved for tracking multiple targets. Since the waveguides 510, 515, and 520 cannot be-moved physically through each other, handover must occur between adjacent waveguides.

For example, referring to FIG. 5, if the antenna system 500 was tracking a 30 GHz signal using the first waveguide 510, the first waveguide 510 would be scanned until it reached the location of the third waveguide 520 operating at 44 GHz. At that point, since the first waveguide 510 cannot physically move through the third waveguide. 520 operating at 44 GHz, the first waveguide 510 would stop scanning. At that point, the second waveguide 515 operating at 30 GHz on the other side of the third waveguide 520 would pick up the signal and continue the scan over the hemispherical lens 502. Thus, the first waveguide 510 "hands off" the signal to the second waveguide 515 for the 30 GHz signal. However, there would be a gap in the coverage during the hand off due to the physical interference of the third waveguide 520 operating at 44 GHz. Similarly, to track a 44 GHz signal across the entire hemisphere, the first waveguide 515, and the second waveguide 515 would be moved to positions proximate the ground plane 505, which would allow the third waveguide 520 to freely scan nearly the entire hemispherical lens 502. Thus, by combining the two scanning techniques, multiple signals operating at 30 GHz and 44 GHz may be simultaneously tracked.

Although this invention has been describe for use with a spherical (Luneberg) lens 110 those skilled in the art will appreciate that the waveguide 116 may be made planar and used to move the guide slot 136 in the focal plane of a planar reflector or a planar lens to provide a mechanical scan of the beam.

The present invention provides several advantages over conventional systems. First, since the guide slot 136 may be positioned at any latitudinal position, a beam pattern may be formed at any elevation and azimuth position to provide approximately hemispherical coverage. Therefore, losses due to scalloping can be reduced. Second, since the present invention uses mechanical scanning, the number of active switching devices is eliminated, thereby greatly reducing the overall complexity of the antenna system and thus significantly reducing the cost of the antenna system. Although mechanical beam scanning is slower than electronic beam scanning, the scanning speed of the mechanical system for most applications, such as tracking a target from a moving platform, is acceptable. Thus, any decrease in scanning speed is outweighted by the improved performance and decreased cost associated with the present invention.

Other alternative embodiments will become apparent to those skilled in the art to which an exemplary embodiment pertains without departing from its spirit and scope. Accordingly, the scope of the present invention is defined by the appended claims rather than the foregoing description.

What is claimed is:

1. A mechanical scanning feed, comprising:

a waveguide including a movable wall assembly, the movable wall assembly having at least one guide slot;

an end wall located on the moveable wall assembly and positioned proximate to the guide slot; and, a drive assembly manipulating the position of the movable wall assembly along the waveguide in a direction parallel to the propagation path of the energy, wherein the motion by the drive assembly changes an elevation angle of a portion of the energy propagating exiting through the guide slot.

2. The mechanical scanning feed of claim 1, wherein said end wall is positioned one-quarter of a wavelength from the guide slot.

3. The mechanical scanning feed of claim 1, further comprising a rotary joint adjacent to a delivery point to the waveguide of the propagating energy allowing for azimuth rotation of the waveguide.

4. The mechanical scanning feed of claim 3, further comprising at least one choke joint located adjacent to the rotary joint to prevent leakage of the energy propagating.

5. The mechanical scanning feed of claim 1, further comprising at least one end wall choke joint positioned proximate to the end wall to prevent energy from passing the end wall.

6. The mechanical scanning feed of claim 1, wherein the guide slot is oriented perpendicular to the movement of the movable wall assembly.

7. The mechanical scanning feed of claim 1, wherein the drive assembly comprises a plurality of motors.

8. The mechanical scanning feed of claim 7, further comprising at least two movable wall portion choke joints placed to prevent leakage of the propagating energy.

9. The mechanical scanning feed, of claim 1, wherein the moveable wall assembly comprises a single moveable wall portion.

10. The mechanical scanning feed of claim 9, wherein the single moveable wall portion comprises a plurality of guide slots, each having a width dimension and a length dimension.

11. The mechanical scanning feed of claim 10, wherein each of the plurality of guide slots has the same length dimension and the same width dimension.

12. The mechanical scanning feed of claim 10, wherein each of the plurality of guide slots has a different width dimension.

13. The mechanical scanning feed of claim 1, wherein said movable wall assembly comprises:

a first moveable wall portion having a single guide slot having a width dimension; and a second moveable wall portion proximate to the first moveable wall portion, having a plurality of guide slots, wherein each guide slot in the second moveable wall portion has a width that is less than the width of the guide slot in the first moveable wall portion, and wherein the second movable wall portion and the first movable wall portion move independently to align at least one of the plurality of guide slots of the second moveable wall portion with the guide slot of the first moveable wall portion to vary a beam shape of the exiting propagating energy.

14. The mechanical scanning feed of claim 13, wherein each of the plurality of guide slots in the second moveable wall portion has a different width dimension.

15. An antenna system with a mechanical scanning feed, comprising:

a lens;

a radio frequency source; and a feed assembly, comprising:

a waveguide including a movable wall assembly, the movable wall assembly having a guide slot;

an end wall located on the moveable wall assembly and positioned proximate to the guide slot; and, a drive mechanism manipulating the position of the movable wall assembly along the waveguide parallel to the propagation path of the energy, wherein the motion by the drive mechanism changes an elevation angle of a portion of the energy propagating in the waveguide exiting through the guide slot.

16. The system of claim 15, wherein the lens is spherical.

17. The system of claim 16, wherein the waveguide is curved and the curvature of the waveguide substantially approximates the curvature of the spherical lens.

18. The system of claim 15, further comprising a rotary joint adjacent to a delivery point of the waveguide of the propagating energy.

19. The system of claim 15, wherein the moveable wall assembly comprises a moveable wall portion.

20. The system of claim 19, wherein the moveable wall assembly comprises a plurality of guide slots, each having a width dimension and a length dimension.

21. The system of claim 20, wherein each of the plurality of guide slots has the same length dimension and the same width dimensions.

22. The system of claim 20, wherein each of the plurality of guide slots has a different width dimension.

23. The system of claim 15, wherein said movable wall assembly comprises:

a first moveable wall portion having a single guide slot having a width dimension; and a second moveable wall portion proximate to the first moveable wall portion, having a plurality of guide slots, wherein each guide slot in the second moveable wall portion has a width that is less than the width of the guide slot in the first moveable wall portion, and wherein the second movable wall portion and the first movable wall portion move independently to align at least one of the plurality of guide slots of the second moveable wall portion with the guide slot of the first moveable wall portion to vary a beam shape of the exiting energy.

24. The system of claim 23, wherein each of the plurality of guide slots in the second moveable wall portion has a different width dimension.

* * * * *